United States Patent [19]

Campbell et al.

[11] Patent Number: 4,499,955

[45] Date of Patent: Feb. 19, 1985

[54] BATTERY POWERED MEANS AND METHOD FOR FACILITATING MEASUREMENTS WHILE CORING

[75] Inventors: Frank L. Campbell, Santa Ana; Dean C. Barnum, Fullerton; William C. Corea, Placentia, all of Calif.

[73] Assignee: Chevron Research Company, San Francisco, Calif.

[21] Appl. No.: 522,923

[22] Filed: Aug. 12, 1983

[51] Int. Cl.[3] ..... E21B 47/09

[52] U.S. Cl. ..... 175/46; 175/58

[58] Field of Search ..... 175/46, 45, 40, 58, 175/244, 155

[56] References Cited

U.S. PATENT DOCUMENTS

| | | | |
|---|---|---|---|
| 2,929,612 | 3/1960 | Le Bus, Sr. | 175/58 |
| 3,693,428 | 9/1972 | Le Peuvedic et al. | 73/151 |
| 3,982,433 | 9/1976 | Stout | 73/155 |
| 4,134,100 | 1/1979 | Funke | 175/40 |

FOREIGN PATENT DOCUMENTS

| | | | |
|---|---|---|---|
| 0636372 | 12/1978 | U.S.S.R. | 175/46 |

*Primary Examiner*—James A. Leppink
*Assistant Examiner*—Hoang C. Dang
*Attorney, Agent, or Firm*—H. D. Messner; Edward J. Keeling

[57] ABSTRACT

In accordance with the present invention, rotation of the inner barrel relative of the axis of symmetry of the core barrel (indicative of core twist off or core sand erosion during coring operations) is detected by a novel sensor combination comprising a battery-powered Hall-effect device fitted to the inner barrel imbedded in a support sleeve of a custom safety sub attached to the outer core barrel adjacent to a single signature magnet.

During coring, circumferential passage of the Hall-effect device adjacent to the signature magnet (during rotation of the outer core barrel to generate a core), produces a series of signals of constant repetition rate. But with the occurrence of rotation of the inner core barrel irregular repetition intervals are produced at uphole indicating equipment connected to the Hall-effect device through conventional downhole telemetering and power generating equipment. Result: sticking and jamming of the core can be immediately detected and uphole parameters modified to ease unsafe conditions.

Use of a battery pack to power the Hall-effect device, simplifies operations, especially where the present invention is used in conjunction with the MWC mud pulse telemetering equipment.

11 Claims, 6 Drawing Figures

BATTERY POWERED MEANS AND METHOD FOR FACILITATING MEASUREMENTS WHILE CORING

SCOPE OF THE INVENTION

This invention relates to the art of evaluating an earth formation penetrated by a well bore by means of cores taken from such formation and more particularly, to a method and apparatus for generating useful measurements while the core barrel is positioned in the well bore and is operating to extract the core from the formation. Such information will hereinafter be referred to as "measurements while coring" or "MWC" data.

BACKGROUND OF THE INVENTION

The development of downhole instrumentation to evaluate drilling and coring of earth formations, has been given impetus by various governmental committees and councils. Prognosis: While instrumentation and uses involving measurements while drilling (or "MWD"), are well-documented, gains to be obtained from measurements while coring (or "MWC") have not yet crystallized. Reasons: Many of most difficult well control problems occur when a core barrel is the well bore. Not only is the ability to handle well kicks reduced (because of reduced circulation capability) but there is increased likelihood of plugging and jamming.

That is to say, the benefits to be gained from MWC during exploratory coring have not been documented in sufficient fashion to outweigh the safety concerns of the field operators. Moreover, the type of real-time data desired or justified, is subject to speculation.

In our prior application, op. cit., we describe use of a single measurement means mounted adjacent to the uphole terminus of the inner core barrel to monitor rotation, if any, of the inner barrel. Such rotation is surprisingly indicative of core twist-off or core sand erosion as the core is being extracted. One element of the measuring means can be a Hall-effect device powered by electrical energy generated by a generator and mud turbine housed at a drill string segment, slightly uphole from the Hall-effect device.

When the time allowed for performing coring operations is long, electrical powering of the Hall-effect device, as previously described, has proven to be quite useful. But for shorter—timewise—coring situations, operations, using energy generated by downhole battery means, have proven to be surprisingly efficient.

SUMMARY OF THE INVENTION

In accordance with the present invention, both a mud pulse generator for telemetering data uphole, and a solid state, Hall-effect device for detecting inner core barrel rotation, are powered via a downhole battery means. Electrical connection of the battery means vis-a-vis the Hall-effect device as well as the mud pulse generator is by means of a conventional wiring harness. Mechanically, the Hall-effect device is imbedded in a support ring of a custom safety sub attached to the outer core barrel, while the battery means is mounted uphole within a drilling string segment housing the mud generator.

By the term "downhole battery means" it is meant to include any dc voltage source capable of powering the Hall-effect device and mud pulse generator device during downhole coring operations in accordance with the present invention. In this regard, chemical energy transduction is preferred, and between a conventional wet storage battery containing an electrolyte and a series of dry-cell batteries, the latter has preference in accordance with the present invention because of ease of operations, simplicity of maintenance and inherently low costs.

During coring, passage of the Hall-effect device device adjacent to the magnet (during rotation of the outer core barrel to generate a core), produces a series of signals of constant repetition rate. But with the occurrence of rotation of the inner core barrel (indicative of core twist-off, or core sand erosion), a change in repetition rate is produced at uphole indicating equipment connected to the Hall-effect device through the mud pulse generator. Result: sticking and jamming of the core can be immediately detected and uphole parameters modified to ease unsafe conditions. The safety sub of the present invention allows use of conventional telemetering equipment uphole, easily houses the Hall-effect device adjacent to the signature magnet as well as facilitates communication of data uphole for operator evaluation and reactive response, if required.

DESCRIPTION OF THE PREFERRED EMBODIMENT

Figure 1:
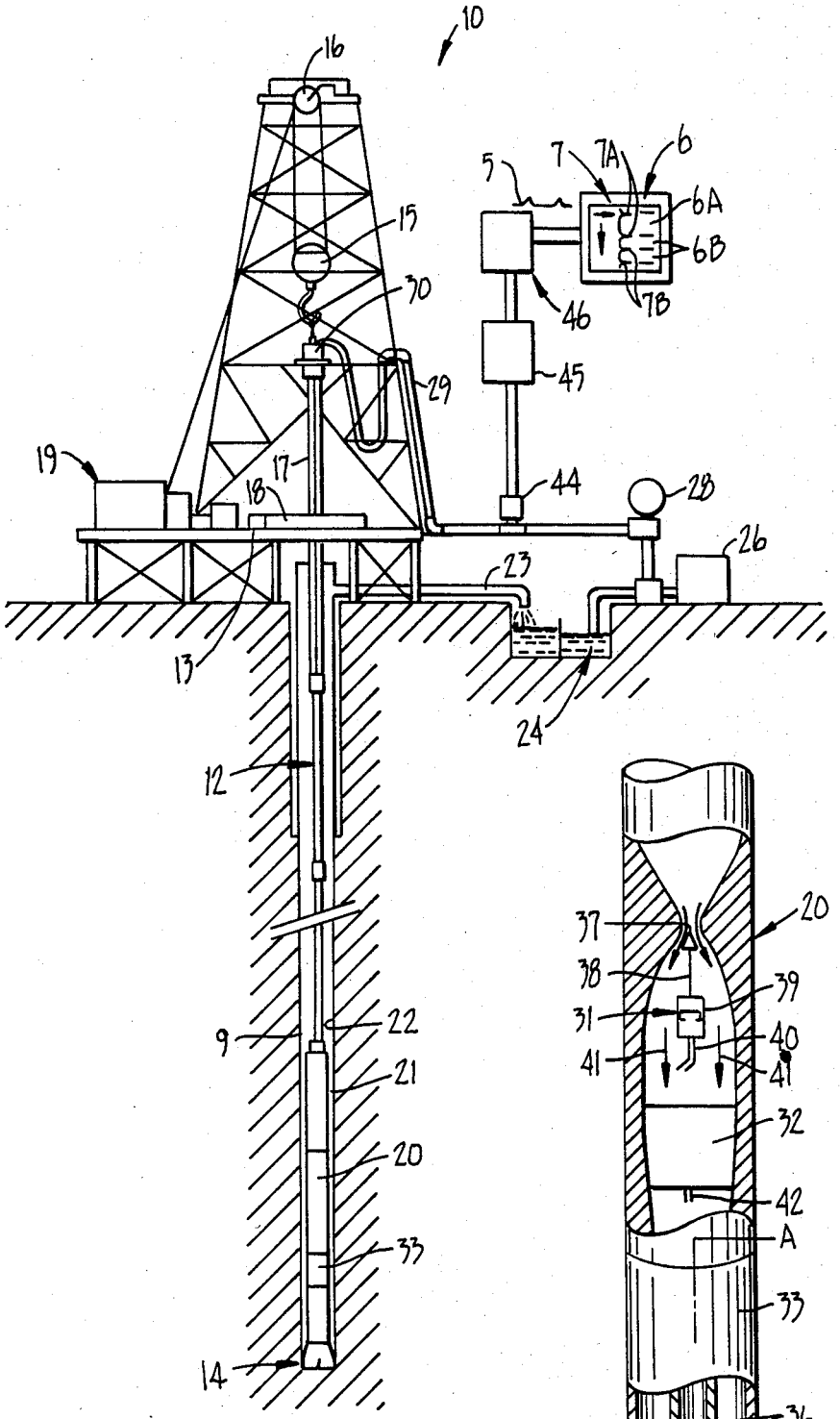
FIG. 1 is a schematic view of a well bore and drilling derrick showing the environment in accordance with the present invention.

Referring now to FIG. 1, the general environment is shown in which the present invention is employed. It will, however, be understood that the generalized showing of FIG. 1 is only for the purpose of showing a representative environment in which the present invention may be used, and there is no intention to limit applicability of the present invention to the specific configuration of FIG. 1.

The coring apparatus shown in FIG. 1 has a derrick 10 which supports a drill string or drill stem 12 which terminates in a core barrel 14. As is well known in the art, the entire string may rotate, or the drill string may be maintained stationary and only the outer core barrel rotated. The drill string 12 is made up of a series of interconnected segments, with new segments being added as the depth of the well increases. The drill string is suspended from a movable block 15 of a winch 16 and the entire drill string is driven in rotation by a square kelly 17 which slidably passes through but is rotatably driven by the rotary table 18 at the foot of the derrick. A motor assembly 19 is connected to both operate winch 16 and rotary table 18.

The lower part of the drill string may contain one or more segments 20 of larger diameter than other segments of the drill string. As is well known in the art, these larger segments may contain sensors and electronic circuitry for sensors, and power sources, such as mud driven turbines which drive generators, to supply the electrical energy for the sensing elements. A typical example of a system in which a mud turbine, generator and sensor elements are included in a lower segment 20 is shown in U.S. Pat. No. 3,693,428 to which reference is hereby made. These elements within segment 20 will hereafter be referenced as "measuring while coring" elements or "MWC" elements. During coring a large mud stream is in circulation. It rises up through the free annular space 21 between the drill string and the wall 22 of well bore 9. That mud is delivered via a pipe 23 to a filtering and decanting system, schematically shown as tank 24. The filtered mud is then sucked by a pump 26, provided with a pulsation absorber 28, and is delivered via line 29 under pressure to a revolving injector head 30 and thence to the interior of the drill string 12 to be delivered to the core barrel 14 as well as to MWC elements within segment 20.

The mud column in drill string 12 also serves as the transmission medium for carrying signals of one or more coring parameters to the surface. This signal transmission is accomplished by the well known technique of mud pulse generation whereby pressure pulses are generated in the mud column at segment 20 in a form capable of being detected at the earth's surface. The signals are representative of a selected coring parameter detected within custom sub 33 above the core barrel 14.

A particular coring parameter to be sensed by the present invention is rotation of the cylindrical inner barrel 34 (see FIG. 2) even though outer barrel 36 also rotates. But other parameters could also be sensed if desired, along lines previously mentioned.

Figure 2:
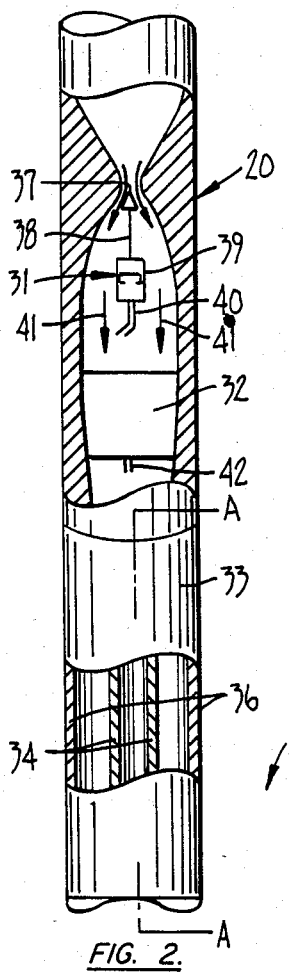
FIG. 2 is an enlarged section of the drill string of FIG. 1 illustrating still further the environment to which the present invention relates.

FIG. 2 also illustrates in schematic form, generation of mud pulses within drill string segment 20 via mud pulse generator 31 so as to provide indication of the aforementioned parameter associated with operations of core barrel 14.

As shown, the drilling mud flows through a variable flow orifice 37 control by plunger 38. The plunger 38 has a valve driver 39 whose electrical conductors 40 extend through battery pack 32 downhole to and make electrical connection with elements within sub 33. The signals generated within the sub 33 cause variations in the size of orifice 37 through controlled movement of the plunger 38 via operation of valve driver 39. Stored energy within the battery pack 32 is transmitted to custom sub 33 via conductors 42 for use in detecting rotation of the inner core barrel 34 about central axis A—A of symmetry as discussed in detail below. As seen in the FIG., mud flow is downward in the direction of arrows 41 and, although impacking upon the battery pack 32 is carried therethrough so as not to hinder mud circulation.

Uphole, the pressure pulses established in the mud stream as a function of the aforementioned selected coring parameter, are detected at signal transducer 44 (FIG. 1) which converts the mud pulses to electrical signals having an amplitude (or intensity) proportional to the pressure in the duct. A filter 45 removes parasitic signals due to the steady pressure pulsations of the pump 26 not removed by pulsation absorber 28. Decoding device 46 produces a record of signal response 5 whose amplitude v. time characteristic is representative of the coring parameter of interest, as set forth below.

It should be noted that instead of using the electro-fluid transducing system of FIG. 2, modifications in this regard are possible. For example, electrical conductors 40 and 42 could be connected—directly—to suitable transducing and decoding means located at the earth's surface. Such direct connection would, of course, be conditioned on the fact that adequate protection of the conductors 40, 42 within the drill string is possible; i.e., conductor abuse during coring operations would be minimal.

As previously indicated, while various classes of coring parameters at core barrel 14 could be sensed during operations, it has been found that in the occurrence of relative rotation of the inner core barrel 34, as the outer barrel 36 is also rotating, is surprisingly indicative of unsafe coring conditions at the bottom of the well bore 9. That is to say, when the inner barrel 34 starts to rotate about central axis of symmetry A—A of sub 33 and core barrel 14, immediate uphole action is necessary. Such occurrence is indicated at decoding device 46 by a change in the repetition interval 6 of signal 5 measured between pulses 7 associated with the coring operation. That is to say, rotation only of the outer core barrel 36 would provide pulses 7A of constant repetition spacing 6A, while rotation of the inner core barrel 34 as the outer core barrel 36 also rotates, produces and changed spacing 6B between the adjacent pulses 7B.

In order to ascertain that the change in interval spacing 6B is actually due to inner core barrel rotation (and not caused by just a change in coring speed), the motor assembly 19 (FIG. 1) is fitted with a tachometer means 13. By recording the rotation of tachometer means 13 as a function of time and cross-checking the result with the recorded signal 5 of decoding device 46, the actual occurrence of inner barrel rotation is more easily determinable.

Figure 3:
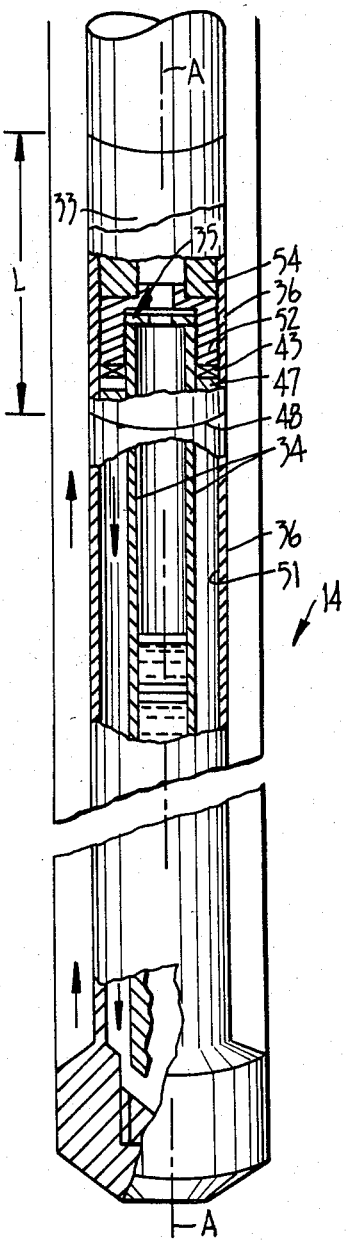
FIG. 3 is a view, partially in section, of a core barrel modified in accordance with the present invention.

FIG. 3 illustrates the construction and operation of core barrel 14, in still more detail, with emphasis being placed on reasons for use of custom sub 33.

Assume that the custom sub 33 has an overall length L equal to that amount of a conventional outer core barrel 36 removed to accommodate sensor unit 35 of the present invention, in safety. I.e., in accordance with a particular design that is useful in the present invention, a conventional core barrel 14 has to be modified as follows. The uphole end of the outer barrel 36 must be cut away, but the remaining terminus should be provided with a flanging surface 48. While the inner barrel 34 remains constructionally intact (except for modifications to mount an element of the sensor unit 35 as discussed below) a new core bearing and race support must be first provided. This is achieved via mounting the removed, previously used, core bearing 43 and the race between ledge 47 (on inner side surface 51 of outer barrel 36) and bottle-shaped retaining sleeve 52. A take-up ring 54 threadable attaches above sleeve 52 to provide needed axial leverage to affix the sleeve 52 and the core bearing 43 in its new operating environment. When the aforementioned modification has been achieved and inserted into a well bore, not only can cores be easily provided, that is, via rotation of the outer barrel 36 through the operations of the drill string as before, but also any rotation of the inner barrel 34 about axis of symmetry A—A can also be detected via sensor unit 35.

Detection occurs via sensor unit 35 wherein operations in accordance with magnetic principles as discussed below, are provided. Since the sensor unit 35 contains no moving parts, and is not electrically produced by uphole circuitry, if offers high reliability notwithstanding exposure to mechanical shock and vibrations in a well bore environment.

However, note that other types of rotation sensing devices (other than the magneto-electrical type depicted in the FIGS.), can be used during downhole coring operations in accordance with the present invention. For example, a simple electro-mechanical switching circuit could also be used to indicate relative inner barrel rotation, as can an electro-optical system. Both would include a downhole power source momentarily placed in contact with the mud pulsing system of FIG. 2 each time a pair of switch contacts (irrespective of whether or not the latter were mechanical or optical in operation) is closed during relative rotation of the inner barrel. For these systems, such circuit closure would occur only once each revolution of the core barrel, and the contacts would operationally mount between the inner and outer core barrels.

Figure 4:
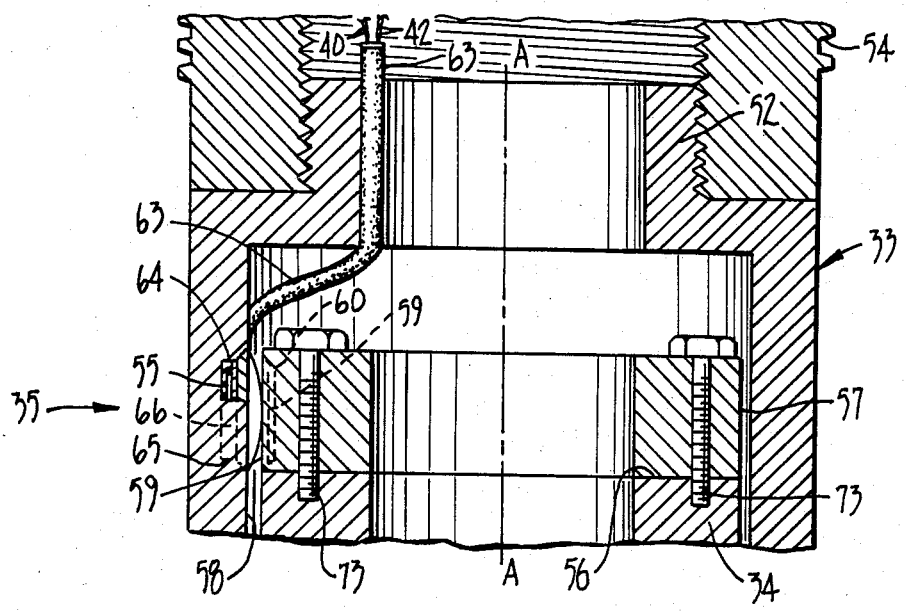
FIGS. 4, 5 and 6 are further details of FIGS. 2 and 3.
Figure 5:
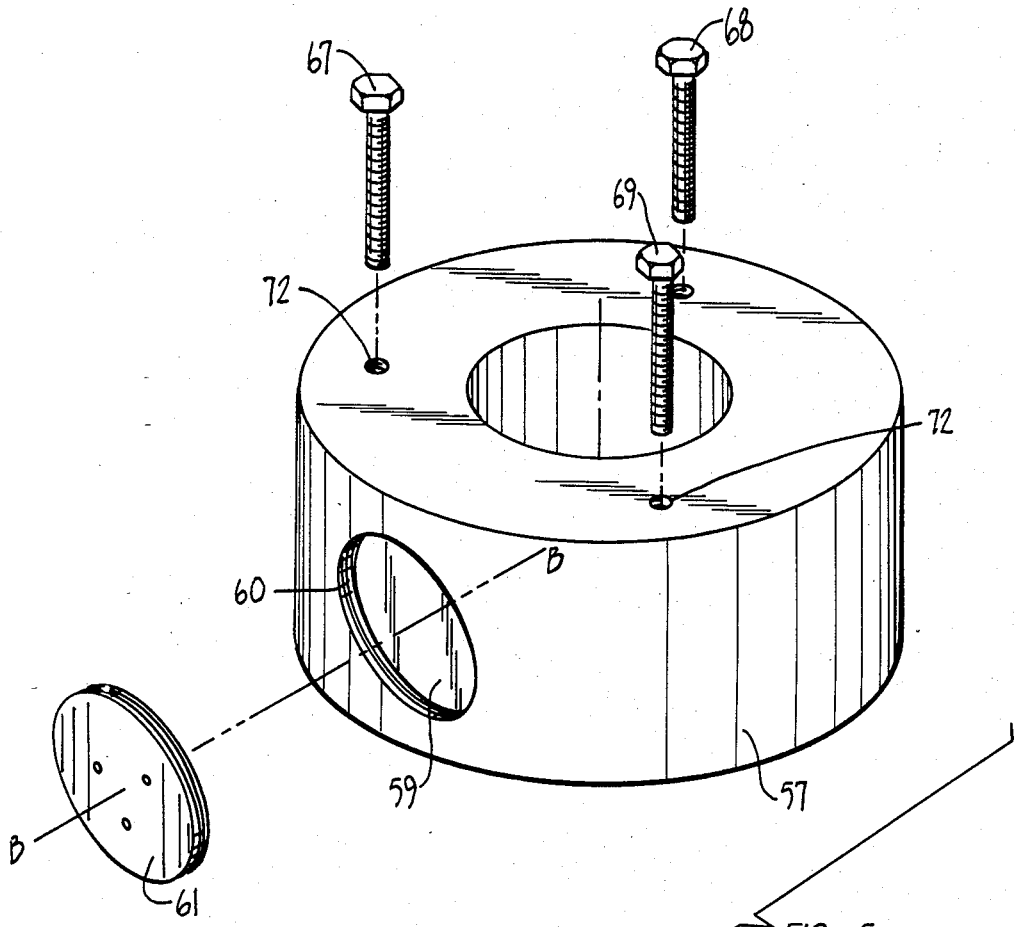

FIGS. 4 and 5 show the sensor unit 35 in more detail.

Although theoretically many kinds of magnetic detection devices could be used as previously mentioned, in this situation the sensor unit 35 of the present invention comprises only two elements: (i) a solid state Hall-effect device 55 mechanically imbedded at inner surface 58 of the previously mentioned retaining sleeve 52 of custom sub 33, but electrically powered by energy developed uphole at battery pack 32 (FIG. 2) above retaining sleeve 54 and (ii) a single signature magnet 59 (see FIG. 5) housed within edge recess 60 of support ring 57. Reason: low power consumption and rugged physical construction of the combination make such device ideal for operation downhole. Discussions of Hall-effect devices 55 can be found at "Art of Electronics" Horowitz et al, Cambridge U. Press, 1980 at pages 387 et seq. and 607 et seq., of which reference is made for incorporation herein as to construction and theory of operation.

The output of the Hall-effect device 55 is carried uphole to MWC circuits via the conventional conductors 40 suitably fitted adjacent to power conductors 42 with a common electrical shield 63 to form a conventional wiring harness.

Since the present invention is only used during coring operations and then is removed from the well bore, more ruggedized connector systems that, say, use pressurized oil, as shown in U.S. Pat. No. 4,319,240, are unnecessary.

Rotational movement of the outer barrel 36 about central axis A—A is, of course, contemplated.

During such operations, the Hall-effect device 55 and signature magnet 59 are placed adjacent to each other only once each revolution of the core barrel. In that way, the series of electrical signals, previously described, is generated on a repetitive basis. That is, each time the device 55 passes in close proximity of the signature magnet 59, a signal is generated. Note that the area of proximity varies with the sensitivity of the Hall-effect device 55, but in general is measured over an imaginary sector defined by a cutting plane that intersects the axis of rotation of the core barrel at about 90 degrees. The sector has a mean radial directional vector momentarily along axis B—B (FIG. 5) that intersects the side wall of the well bore; during each revolution of the core barrel, that sector momentarily captures both the Hall-effect device 55 and the signature magnet 59. Since the conductors 40, 42 and shield 63 also rotate about that axis in synchronization with uphole connection points to driver 39 (FIG. 2) and battery pack 32, respectively, tangling of cabling during coring operations, is prevented.

To reduce the possibility of drilling mud intrusion yet allow easy removal for repair purposes, the Hall-effect device 55 as well as signature magnet 59 are both provided with suitable mounting arrangements within the retaining sleeve 52 and support ring 57, respectively. In the case of Hall-effect device 55, after being potted within epoxy shield 64, it is fitted within a recess 65 formed at the inner surface 58 of the sleeve 52. Recess 65 is capped by a threaded insert 66 through which conductors 40, 42 and shield 63 extend. For magnet 59, its recess 60 (at the circumferential edge of support ring 57, see FIG. 5) is sealed by threadable insert 61 defining an axis B—B normal to, but intersecting the central axis A—A of the assembly.

To drive the Hall-effect device 55, stored energy is transmitted thereto via power conductors 42, as previously mentioned.

Since coring operations usually have a time-duration of only 4–6 hours and due to the fact that Hall-effect device 55 consumes very low amounts of power, a sufficient energy reservoir is provided by a self-contained battery pack 32 uphole from the Hall-effect device 55.

Figure 6:
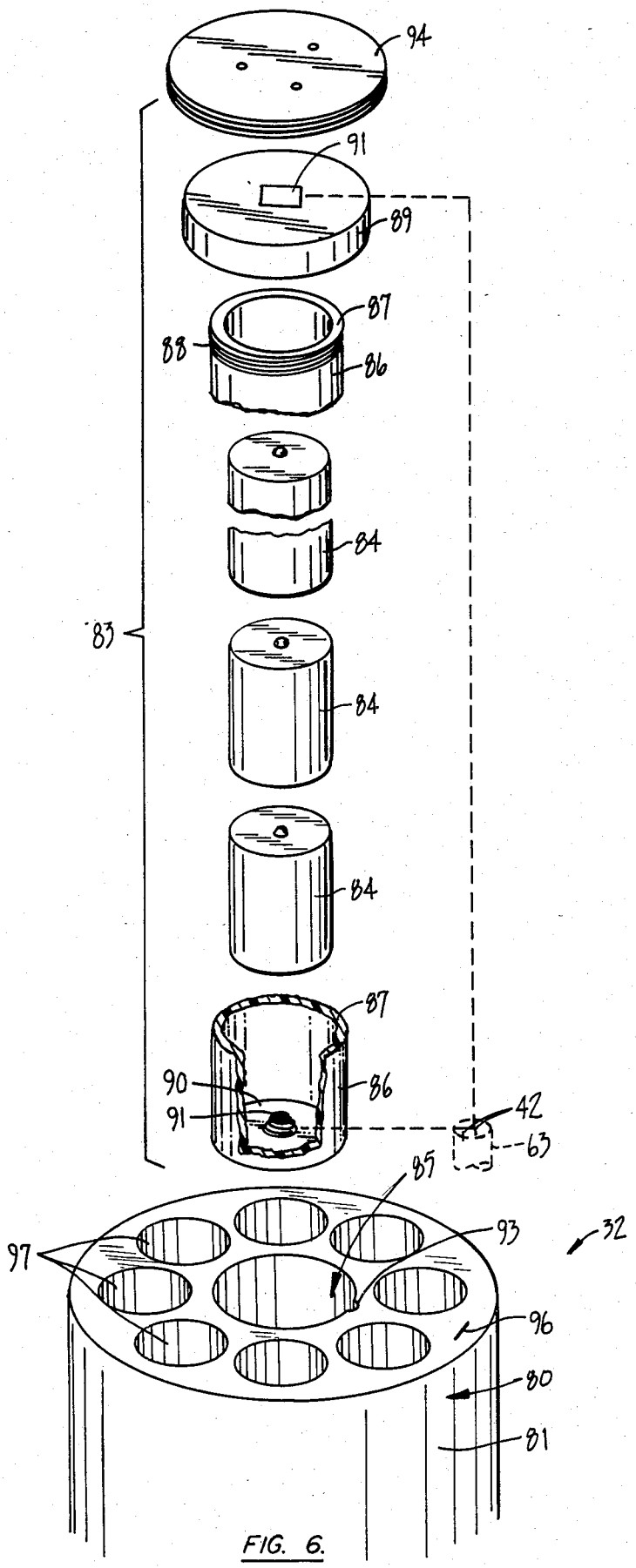

FIG. 6 shows the battery pack 32 in more detail.

As shown, battery pack 32 consists of a heavy-duty main support housing 80 that is releasably mounted at its exterior surface 81 within main drill string segment 20 of FIG. 2, and a lighter subassembly 83 accommodating a series of dry battery cells 84, the subassembly 83 being slidably fitted within cavity 85 of the main housing 80. Battery cells 84 are not directly loaded into cavity 85, however. Instead, they are provided with a separately detachable plastic sleeve 86. Sleeve 86 has a side wall 87 of sufficient thickness to accommodated threads 88 at its upper end, to which is attached cap 89. The cap 89 as well as bottom wall 90 of the sleeve 86 are fitted with conducting tabs 91 to which conductors 42 (schematically shown) are attached.

After battery cells 84 have been mounted into sleeve 86 and cap 89 attached to the sleeve 86, the conductors 42 (as well as driver conductors 40 of FIG. 4) are fitted within flexible shield 63 and the entire assembly positioned within the cavity 85 of the main housing 80. When so positioned, the conductors and shield 63 reside within separate annulus 93 at the circumferential edge of the cavity 85. Thereafter, cavity 85 is closed. Threaded caps 94 (only one of which is shown) are affixed at the ends of the cavity 85.

To insure that battery pack 32 does not prevent loss of drilling mud circulation when mounted within the main drill string segment 20, annular side wall 96 of the main housing 80 is provided with a series of axial extending openings 97 each having an axis of symmetry parallel to the like axis of the housing 80.

From the foregoing description, one skilled in the art can easily ascertain the essential characteristics of the present invention and without departing from the spirit and scope thereof, can make various changes and modifications of the invention to adapt it to various usages and conditions.

For example, some attention as to the materials to be used in the construction of the custom sub 33 as well as for support sleeve 57 are needed. Since these assemblies are to be magnetically non-interactive, they should be of stainless steel or monel.

Consequently, such changes and modifications are proper, equitable and intended to be within the full range of equivalence of the following claims.

What is claimed is:

1. Apparatus for monitoring detrimental conditions associated with extraction of a core from an earth formation penetrated by a well bore using a core barrel having a rotatable outer cylindrical barrel attached to and operationally rotated by, a drill string, and drilling fluid circulating within said well bore as said core is extracted, wherein rotation of a usually stationary inner core barrel coaxial of the outer core barrel during said extraction of said core and its placement thereof within the cylindrical inner barrel, is used to indicate said associated detrimental coring conditions, comprising;

first means mechanically attached to said core barrel and operationally fitted between said outer and inner core barrels for generating a series of electrical signals indicative of relative rotation of the inner core barrel relative to the outer core barrel during extraction of said core from the formation;

downhole battery means connect to said first means for driving same with a dc current during said coring operations, second means uphole from said first means and operational connected thereto for responding to said series of electrical signals indicative of said relative inner barrel rotation wherein occurrence of said relative inner barrel rotation causes operations to be initiated to overcome any associated detrimental condition within said well bore.

2. Apparatus of claim 1 in which said first means for generating said series of electrical signals indicative of said relative rotation of said inner core barrel during extraction of said core from said formation, includes a Hall-effect device operationally attached to the outer core barrel and carried in rotation therewith, and a single signature magnet fitted to said inner core barrel wherein said series of signals are generated by said Hall-effect device on a repetitive basis each time said Hall-effect device passes in close proximity of said single signature magnet, said region of close proximity being defined by a cutting plane that intersects the axis of rotation of the core barrel at about 90 degrees, said imaginary sector momentarily capturing said Hall-effect device and said single magnet during rotation thereof.

3. Apparatus of claim 2 in which said downhole battery means is electrically connected to said Hall-effect device for powering said device during coring operations on a continuous basis thereby said series of signals can be generated as the output of said Hall-effect device as repetitive passage of said device adjacent to said single signature magnet over said region of proximity occurs.

4. Apparatus of claim 3 in which said downhole battery means includes a series of dry battery cells, a support housing having a central cavity for releasably receiving said battery cells, and conducting means attached at the ends of said battery cells for providing said driving current for said Hall-effect device during coring operations, said support housing being attached to said drill string above said Hall-effect device in a separate drill string segment.

5. Apparatus of claim 4 in which said support housing is a hollow cylinder with said cavity for said battery cells formed centrally therein, top and bottom threaded caps at ends of said cavity for closure thereof and for supporting said conducting means thereon, and in addition being provided with a series of annular openings in its side wall each parallel to its axis of symmetry to allow circulation of drilling fluid therethrough.

6. Apparatus of claim 4 in which said first means also includes a mud pulse generating means connected to the output of said Hall-effect device and generating a second series of signals in response to said series of electrical signals, said second series of signals being in the form of pressure impulses imparted to the drilling fluid, said mud pulse generating means being housed in said separate drill string segment adjacent to said downhole battery means.

7. Apparatus of claim 6 in which said second means also includes transducer means at the earth's surface for converting the pressure impulses imparted to the drilling fluid to surface electrical signals having amplitude variations proportional to the pressure impulses, and recording means connected to said transducer means for recording said surface electrical signals as a function of time.

8. Method of monitoring the extraction of a core from an earth formation penetrated by a well bore using a core barrel having a rotatable cylindrical outer barrel attached to a drill string, drilling fluid circulating with the well bore to aid in cutting the core from the formation, and a normally stationary cylindrical inner barrel coaxial of the outer barrel to receive the core therein, whereby detrimental coring conditions within the well bore are economically indicated, comprising:

(i) fitting downhole battery means in a separate drill string segment attached to the downhole end of the drill string, (ii) attaching the core barrel fitted with means to monitor rotation of the inner barrel, to said separate drill string segment, said means for monitoring inner barrel rotation being electrically connected to said downhole battery means, (iii) lowering the drill string including said separate drill string segment and core barrel to the selected depth position, (iv) rotating the outer core barrel while drilling mud is being circulated to cut the core from the formation while simultaneously causing the core to be located interior of the cylindrical inner core barrel, (v) detecting by said downhole battery powered means attached to said core barrel, rotation of the inner core barrel relative to the outer core barrel via a series of electrical signals indicative thereof, (vi) monitoring said series of signals at the earth's surface adjacent to the well bore so that when inner barrel rotation does occur, operations can be initiated to overcome any detrimental condition within the well bore so indicated.

9. The method of claim 8 in which step (vi) is further characterized by the sub-steps of:

establishing a signal repetition rate for said series of signals wherein said inner core barrel is known not to rotate, and comparing that rate with a subsequently generated changed rate resulting from inner barrel rotation.

10. The method of claim 8 in which step (v) is further characterized by the sub-steps of:

generating a series of electrical signals, each signal of said series having a characteristic indicative of the coincidence of a known point on the rotating outer core barrel being adjacent to a known point on the normally stationary inner core barrel defining a region of proximity for signal generation, transmitting said series of electrical signals uphole from said core barrel.

11. The method of claim 10 with the additional sub-steps of:

converting said series of electrical signals to a series pressure impulses imparted to the drilling fluid, and reconverting at the earth's surface said pressure impulses to second series of electrical signals, recording the second series of signals as a function of time.

* * * * *